United States Patent [19]

Stempin

[11] Patent Number: 4,635,800

[45] Date of Patent: Jan. 13, 1987

[54] WALL MOUNTED SKI HOLDER

[76] Inventor: Gary A. Stempin, 504 11th Street W., Columbia Falls, Mont. 59912

[21] Appl. No.: 778,854

[22] Filed: Sep. 23, 1985

[51] Int. Cl.[4] ..... A47F 7/00

[52] U.S. Cl. ..... 211/70.5; 280/814

[58] Field of Search ..... 211/70.5, 60.1, 13, 211/89; 280/814, 815

[56] References Cited

U.S. PATENT DOCUMENTS

| | | | |
|---|---|---|---|
| 941,779 | 11/1909 | Hodgkins | 211/60.1 X |
| 2,581,824 | 1/1952 | Windahl | 211/89 X |
| 2,956,812 | 10/1960 | Lundquist | 211/70.5 X |
| 3,570,681 | 3/1971 | Kinshofer | 211/70.5 |
| 3,687,472 | 8/1972 | Struble, Jr. | 280/814 |
| 3,905,214 | 9/1975 | Bell | 211/70.5 X |
| 4,269,435 | 5/1981 | Järvenkylä et al. | 211/70.5 |
| 4,391,376 | 7/1983 | Finnegan | 211/70.5 |

*Primary Examiner*—J. Franklin Foss
*Assistant Examiner*—Sarah A. Lechok Eley
*Attorney, Agent, or Firm*—Keith S. Bergman

[57] ABSTRACT

A flexibly resilient unitary ski holder, fastenable on a vertical support, to positionally maintain the tip portion of a vertically positioned pair of skis. The holder provides a flat base with a medial, partially severed "T" shaped holding structure resiliently extendable therefrom to engage the tip portions of skis. Lateral lugs on the base maintain ski spacing. Particular configuration allows formation by molding but provides substantial strength and durability.

6 Claims, 6 Drawing Figures

FIG. 1
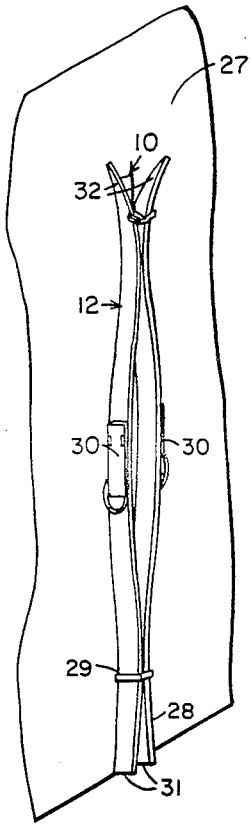
FIG. 2
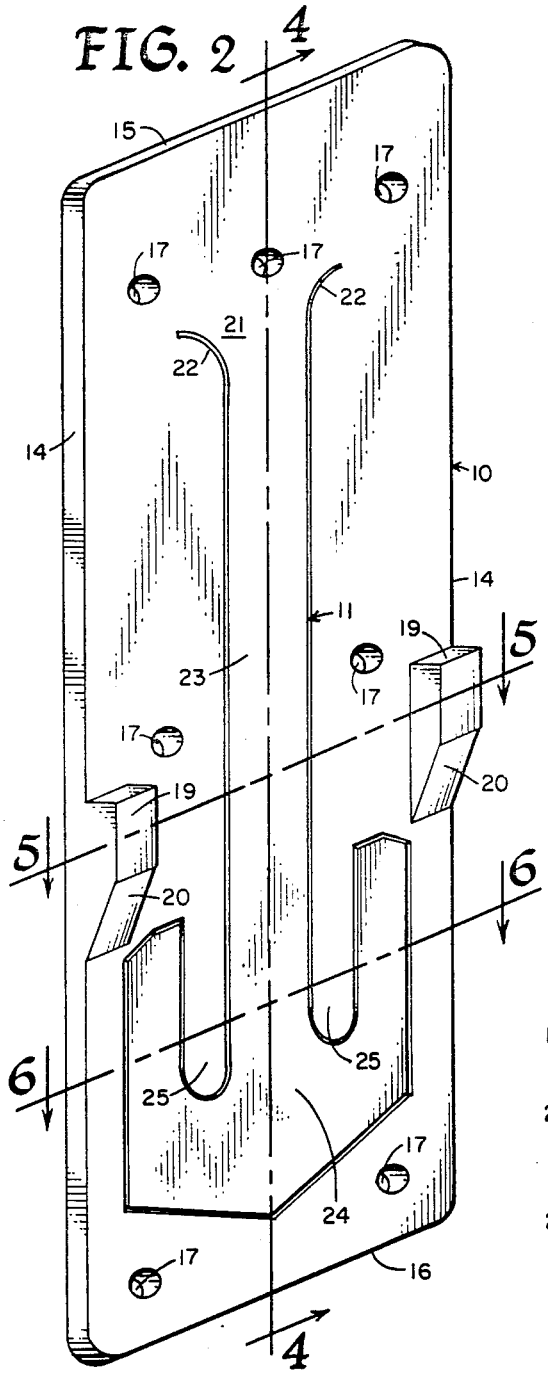
FIG. 3
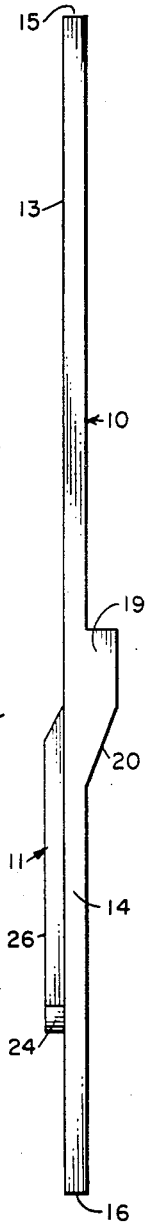
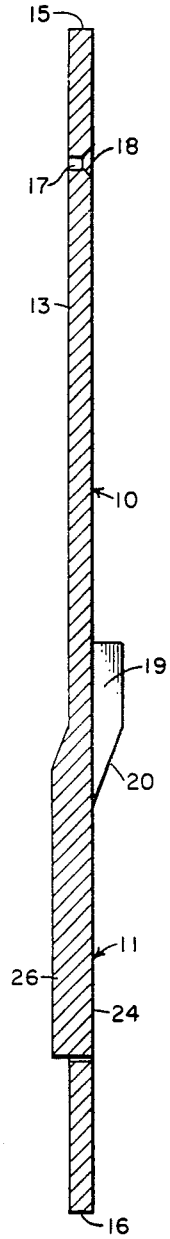
FIG. 4
FIG. 5
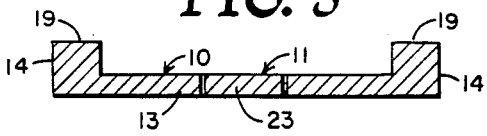
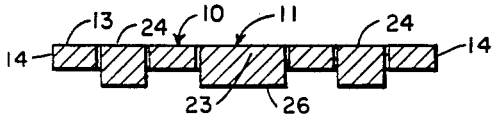
FIG. 6

WALL MOUNTED SKI HOLDER

BACKGROUND OF INVENTION

A. Related Applications

There are no applications related hereto now filed in this or any foreign country.

B. Field of Invention

My invention relates generally to wall mounted ski holders and more particularly to such a holder that is a unitary structure formed of resiliently deformable material with holding portion defined by partial severance.

C. Description of the Prior Art

The storage of skis in and about a skiing area and elsewhere creates an ever present problem. If skis are left about in a random fashion, especially in an area frequented by humans, there is a substantial probability that the humans and the skis may come into contact to the damage of either or both. Responsively various devices have heretofore become known for the orderly storage of skis in areas where they present no substantial hazard of damage to themselves or injury to humans.

A first class of ski storage devices includes selfsupporting storage racks which commonly are of substantial size, are supported on a horizontal surface, and store a substantial number of skis either individually or in pairs. Such racks have come into common use in skiing areas but they generally are large and bulky, relatively expensive, and they commonly occupy substantial space in areas where space is oftentimes at a minimum. Such racks normally are not adaptable to storage of single pairs or small numbers of skis by reason of their expense and size. These problems are accentuated when such racks are used for interior storage.

This first class of ski storage device is readily distinguished from a second class that provides relatively small, clip-like holding devices that are supported on a secondary structure, at a spaced distance above a supporting surface, to releasably hold and positionally maintain a pair of skis, or possibly individual skis if desired. This second class of holding device is distinguished from the larger, self-supporting ski racks in that they do not occupy any substantial horizontal area, they use already existing structures for support and store supported skis in immediate adjacency to a structure so that the skis do not create new hazards or occupy space that is generally otherwise usable. This second class of device may be quite readily and conveniently used inside enclosed structures as well as outside.

The second class of ski holding device, in the prior art, has generally taken the form of a base structure fastened on a vertical wall and movably supporting some sort of a hook-like holding element, normally pivotably mounted and biased by gravity to a downwardly angled supporting position. Such a holder generally supports a single pair of skis by frictional engagement between holding element and ski. The degree of ski support is not particularly great since the frictional engagement between the elements depends only on gravity. In fact, with such structures, the problem of support has been sufficient that various high friction surface coatings have been added, especially to the holding device, to assure sufficient frictional contact to positionally maintain skis being held. Such structures, in addition, have generally been made of metal to obtain desired mass, necessary rigidity and strength, and appropriate pivotable joinder of parts.

My invention differs from this second class of prior art by providing a ski holder formed as a unitary structure from resiliently deformable polymeric material. The holding structure per se is partially severed from the medial portion of the base so that it might be moved outwardly to engage a pair of skis in notches defined in the end portion thereof. The skis are held primarily by reason of resilient deformation of the holding structure itself, rather than necessarily by action of gravity on either the clip or the ski. The holding structure of my device is particularly configured and positioned so that skis are supported in their tip area, and this, coupled with the nature of the support structure and normal ski configuration, provides a positive support for skis that is not dependent upon gravity for its action, though the action may be aided by gravity. My device will hold and positionally maintain skis that are supported by some underlying surface, such as a floor, against gravity bias. My holder is particularly configured to provide both necessary strength and rigidity in the various portions where such characteristics are required, but it yet has such a nature as to be formable by molding from polymeric materials having appropriate resilient and elastic deformability.

My holder will hold skis of various sizes, shapes and types as it adjusts thereto by reason of its configuration, elastic deformability and positionability. In general the device is adapted to hold a pair of skis but it will also support individual skis if desired.

My invention differs from the prior art not in any single structure or function per se, but rather in the unique synergistic combination of all of the structures and functions that in combination constitute the invention as specified and claimed.

SUMMARY OF INVENTION

My invention generally provides an elongate sheet-like base having a partially severed medially portion forming an elongate "T" shaped arm with notches in the "T" arm facing the unsevered portion so that that portion may be moved away from the base to accept a pair of skis between the notches defined in the "T" arm and the body of the device. The ski holder is supported on a vertical surface, such as a wall, preferably in a vertical position that is at least as high as the tip portion of a pair of skis to be held.

The outer end part of the "T" shaped arm is thickened to provide rigidity and strength in this area for greater durability. The body of the device has means to aid fastening to a supporting structure. Lugs are provided on each side of the base to maintain skis in spaced arrayed so that they may be properly held by the "T" shaped arm. The configuration of my holder is such that it may be formed in a unitary fashion by molding resiliently deformable polymeric material.

In creating such a ski holding device, it is:

A principal object of my invention to create a relatively small holder for individual or paired skis that may be formed as a unitary structure from resiliently deformable material, such as a polymere or a resin, by ordinary molding processes.

A further object to create such a device that provides a medial, partially severed portion, shaped as a "T" with notches defined therein, to move away from the base to engage and support the sides of skis to be held thereby.

A further object to provide a ski holder that is positionable on a vertical support at a height to contact the tip portion of skis to be held so that the skis are supported by the "T" shaped holding arm by reason of its resilient deformability as well as gravity bias of skis being held.

A still further object to provide a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout:

FIG. 1 is an isometric view of my holder positioned on a vertical wall and holding a pair of skis to show its use and operation.

FIG. 2 is an enlarged isometric view of my ski holder showing its various parts, their configuration and relationship.

FIG. 3 is an orthographic side view of the holder of FIG. 1, taken from the left side of that Figure, looking inwardly toward it.

FIG. 4 is a medial, vertical cross-sectional view of the holder of FIG. 2, taken on the line 4—4 thereon in the direction indicated by the arrow.

FIG. 5 is a horizontal cross-sectional view of the holder of FIG. 2, taken on the line 5—5 thereon in the direction indicated by the arrows.

FIG. 6 is a horizontal cross-sectional view of the holder of FIG. 1, taken on the line 6—6 thereon in the direction indicated by the arrows.

DESCRIPTION OF THE PREFERRED EMBODIMENT

My invention generally provides base 10 having a medial severed portion forming holding element 11, the free portion of which may be moved away from the base to engage one or a pair of skis 12 for support.

Base 10 is a flat, rectilinear element comprising by planar body 13 defined by longer peripheral sides 14 and shorter top 15 and bottom 16. Corners 17 of the body are preferably rounded to lessen probability of damage to persons or objects coming into contact with them. Means are provided to aid the mechanical fastening of the back of the body of the base to an adjacent supporting surface, in the instance illustrated, plural holes 17 spacedly defined in the base and having outwardly flaring frontal portions 18 to receive countersunk screw heads, nails or other fastening elements.

The peripheral configuration and dimensioning of the base are not critical so long as its longer dimension be somewhat greater than the width of a pair of skis that are to be held and the narrower dimension is somewhat greater than the thickness of two such skis. In general, with consideration of strength and rigidity, this dimensioning is approximately three by eight by one-forth inches. The base must be formed from some reasonably strong, durable material of a resiliently, and preferably elastically, deformable nature.

Immediately inwardly adjacent longer sides 14 of the base, in a vertically medial position, there are defined similar opposed spacing lugs 19 extending normally outwardly from the face of the base. Each of these lugs, in the instance illustrated, provides a body of rectilinear shape with ramp-like wedge 20 depending therefrom. These lugs space a pair of skis held by my holder by maintaining the tip portions of the skis at a spaced distance from each other so that the shank of the holding element may pass between them to allow them to be held thereby. This structure is not a necessary or essential part of my invention, thought it does normally aid and enhance its function. The lug structures are preferably formed in the configuration illustrated as an integral and unitary part of the base structure.

Holding element 11 comprises a medial "T" shaped portion of the base that is severed about part of its periphery to define the structure from the base. An uppermost unsevered area 21 partially peripherally defined by upwardly and outwardly curving slots 22 which aid in preventing tearing of this portion of the holding element from the base material, interconnects the base and the holding element. The uppermost unsevered area communicates with elongate body 23 which, in turn, in its lower portion communicates with cross-arm 24 defining inwardly facing ski notches 25 immediately laterally adjacent each side of the body. Cross-arm 24 is of such width as to extend laterally a spaced distance from each lateral side edge of the base and the longer vertical dimension or length of the structure is such that its outermost portion extends to a spaced distance from bottom 16 of the base, all substantially as illustrated in FIG. 2.

Lower portion 26 of the holding element, from a position at a spaced distance above the uppermost extent of the horizontal fastening arm, is somewhat thicker than the rest of the holding element, as shown particularly in FIGS. 3 and 4. This thickened portion 26 provides both extra strength and rigidity to create physical characteristics appropriate to effectively hold and support skis. The thickened structure provides a secondary benefit in that if the back of base 10 is positioned on a flat planar surface, the lower thickened portion 26 of the holding element will necessarily project forwardly a distance from the face of the base and thusly be readily accessible for manual manipulation, whereas if the entire holding element were of the same thickness as the base, this would not happen and it might be difficult to initially grasp and manually move the holding element relative to the base.

The exact configuration and dimensioning of the holding element is not particularly critical so long as those attributes conform with required functioning of the element. The width of ski notches 25, that is their dimension perpendicular to the longer dimension of body 23 of the holding element, should be only slightly greater than the thickness of the tip portion of skis to be held by the device so that those skis will nicely fit edgewise into the ski notches. The holding element illustrated is approximately at full scale and its dimensioning, with a body width of approximately one-half an inch and ski notch width of approximately three-eighth of an inch, is considered ideal, though these dimensions may vary within reasonable limits to accommodate particular skis and particular conditions. The depth of the ski notches, that is their dimension in a vertical plane as the holder is orientated in FIG. 2, is not particularly critical but this dimension should be sufficient to allow surface contact of some areal extent with the skis to be held to assure positive positional maintenance. The holding element is preferably formed of the same material and in a unitary fashion with the base, though obviously the two structures might be independently formed of different materials. The material in the uppermost unsevered area 21 must be of a reasonably tough, durable, flexibly resilient nature to allow motion of the holding element relative the base without tearing, fatigue or other physical damage in that area. Preferably, though not necessarily, the material should have some elastic resilience and a surface of some frictional potential to aid in engaging and holding a pair of skis.

I have found polymeric and resinous materials of present day commerce such as polyvinyl chloride, polypropylene and various polymeric fluorocarbons to be ideally suited for this purpose, though undoubtedly other materials having similar physical characteristics will serve the purposes of my invention, if not so well. The configuration of my holder is such as to lower the probability of tearing of various portions during use, but to further lessen the probability of such events, the material from which the device is formed should be reasonably resistive to such action. The material must also possess some reasonable strength, durability and rigidity to function as specified.

Having thusly described the structure of my ski holder, its use may be understood.

Firstly, a holder is formed according to the foregoing specification and mechanically fastened upon a supporting surface, such as vertical structural wall 27 as illustrated in FIG. 1. The holder is mounted in a vertical position a spaced distance above any horizontal support therebelow, such as a floor, so that it will be approximately at or immediately below the tip portion of skis 12 to be supported thereby. The holder may be above such a position, but if it be below it, there may be difficulty in mounting and positionally maintaining skis in the holder, and they obviously may not be necessarily vertically orientated. The ski holder is mounted on vertical support 27 by mechanical means such as screws, nails, adhesives, or a combination thereof (not shown). The mechanical fastening must be such as to positionally maintain the clip when subjected to any forces that might be exerted upon it, normally only the bias created by gravity acting upon supported skis.

When the holder is so mounted, it normally will be used to engage and positionally maintain a pair of skis 12, each normally having the somewhat curvilinear shape illustrated in FIG. 1. The skis preferably are fastened together at least in their medially rearward portion 28, by an elastically resilient band 29 or similar device. They may be otherwise fastened as by mechanism (not shown) associated with bindings 30 or other secondary bands or fasteners common in the skiing art. With the skis so fastened with their bottoms 31 facing each other and tips 32 substantially adjacent, the pair is manually manipulated to a position illustrated in FIG. 1, with the tips immediately outwardly adjacent my ski holder. In this position, holding element 11 of my holder is manually raised away from base 10. The skis are positioned with their edges against wall 27 and the face of base 10 of my holder, and manipulated to position their outwardly facing edges within notches 25 defined in the holding element, as illustrated substantially in FIG. 1. When the holding element is so engaged, the pair of skis is adjusted to a somewhat vertical position depending from the ski holder and the pair will be thusly positionally maintained by my holder until removed in a fashion that is the reverse of that described for their establishment.

It is to be particularly noted that skis positioned as aforesaid may be supported against gravity bias by their lowermost portion 33 resting on some horizontal surface beneath my ski holder, if the holder be vertically positioned so that this relationship of elements may exist. It should be further noted, however, that my ski holder is operative if there be no structure supporting the lowermost portion of skis. In this latter situation, holding element 11 will have frictional engagement upon the outwardly facing edges of the skis and since the area of frictional engagement is below and therefore at a downward angle to the point of support of the holding arm, the forces created on that element by the weight skis will tend to frictionally maintain them in the holding arm. Secondly, since the holding element is engaged upon the skis immediately inwardly (relative to the skis) of their tips, and since the skis are positioned relative to each other with their tips extending away from each other, a force will be created upon the holding element having a lateral component to again aid in positionally maintaining the skis in the holding arm and in creating additional frictional engagement between the holding arm and skis. This latter function is generally not accomplished by "S" or "U" shaped, freely pivotable mounting devices that have heretofore been known. My holder mounts and maintains a pair of skis more surely and more securely than those prior art devices.

It is further to be noted from the foregoing description that my holder may be variously sized and configured to accommodate particular skis or sets of skis and may be variously vertically positioned relative to underlying supporting surfaces. In general, however, I have found that one size of holder, dimensioned as specified, will fit most common varieties and types of skis, be they of the downhill or cross-country type and no matter what their length or materials of formation.

It is further to be noted that, although my holder will normally be used with a pair of skis in the fashion indicated, it might also support individual skis in either or both ski notches by reason of frictional contact of the holding arm with the tip portion of a ski, in substantially the same fashion as described for a pair of skis, if not to the same degree.

The foregoing description of my invention is necessarily of a detailed nature so that a specific embodiment of it might be set forth as required. It is to be understood, however, that various modifications of detail, rearrangement and multiplication of parts might be resorted to without departing from the spirit, essence or scope of my invention.

Having thusly described my invention, what I desire to protect by Letters Patent and what I claim is:

1. A holding device for skis, comprising, in combination:

a base formed of resiliently deformable material, peripherally defined by longer side edges and shorter top and bottom edges and having means for mechanical attachment to a supporting structure at a spaced distance above a horizontal supporting surface therebelow; and a holding element defined by severing a substantial portion of the periphery thereof from the medial portion of the base, said holding element having an unsevered portion at a spaced distance downwardly from the shorter top edge of said base, an elongate body communicating therefrom and defining in its lower end part a "T" shaped cross-arm extending laterally a spaced distance from each of the side edges of the base and a spaced distance from the shorter bottom edge of the body, said cross-arm defining, on the side facing the unsevered portion of the holding element, spaced slots to receive the side portions of skis.

2. The invention of claim 1 further characterized by:

said base defining spacing cleats extending a spaced distance forwardly from the face thereof at a vertically medial position inwardly adjacent each of the longer side edges thereof.

3. The invention of claim 1 further characterized by:

the end part of the holding element, opposite the unsevered portion thereof, being thicker then the remaining portion of said holding element and the base.

4. The invention of claim 1, supporting a pair of skis, each ski having a rearward portion and a tip portion, positioned on a vertical supporting surface at a height above any horizontal supportative surface therebeneath at least equal to the distance from the rearward portion to the tip portion of a pair of skis to be supported thereby, and supporting said pair of skis positioned with their bottoms adjacent and having their rearward medial portions releasably fastened together.

5. A ski holder to be supported on a substantially vertical surface and to releasably support a pair of skis, comprising, in combination:

a resiliently deformable sheet-like base of rectilinear peripheral configuration, defined by spaced parallel longer side edges and spaced parallel shorter edges extending perpendicularly between the side edges, having means to aid mechanical fastening to a vertical supporting structure, and further defining opposed spacing lugs in a medial position immediately inwardly adjacent the longer side edges thereof and extending normally forwardly a spaced distance from the face of the base; and a holding element defined in the medial portion of the base by severance of a substantial portion of the periphery thereof from the base, said holding element having an unsevered portion at a spaced distance inwardly adjacent a first shorter side of the base, an elongate body communicating with the unsevered portion and extending away therefrom, said body carrying a perpendicular laterally extending cross-arm in its lower end part, said cross-arm extending on each side of the holding element body to a spaced distance from each of the longer side edges of the holder body and to a spaced distance inwardly adjacent the second shorter edge of said base, defining two spaced notches on each side of the cross-arm body, each notch adapted to accept the side portion of a ski therein.

6. The invention of claim 5 further characterized by:

the severed portion of the holding element, at a spaced distance from the unsevered portion, being thicker than the remaining portion of the holding element and the base; and the slit defining the periphery of the holding element being curved laterally outwardly on each side adjacent the unsevered portion of the holding element.

* * * * *